US005688068A

United States Patent [19]

Kaneta

[11] Patent Number: 5,688,068

[45] Date of Patent: Nov. 18, 1997

[54] PHASE ADJUSTMENT FIXING APPARATUS FOR CAM

[75] Inventor: Tomoo Kaneta, Chiba, Japan

[73] Assignee: Komori Corporation, Japan

[21] Appl. No.: 638,338

[22] Filed: Apr. 26, 1996

[30] Foreign Application Priority Data

May 2, 1995 [JP] Japan ..... 7-108509

[51] Int. Cl.[6] ..... F16B 2/00; B41F 13/24

[52] U.S. Cl. ..... 403/325; 403/24; 403/31; 403/322; 101/248

[58] Field of Search ..... 403/31, 24, 256, 403/261, 321, 322, 325, 373, 374, 409.1, DIG. 9; 101/232, 248; 493/405, 417

[56] References Cited

U.S. PATENT DOCUMENTS

| | | | |
|---|---|---|---|
| 3,793,899 | 2/1974 | Bourbonnaud . | |
| 4,457,231 | 7/1984 | Kawaguchi | 101/248 X |
| 5,156,508 | 10/1992 | Grisley . | |
| 5,357,860 | 10/1994 | Shibita et al. | 101/248 |
| 5,410,959 | 5/1995 | Sugiyama et al. | 101/248 X |

FOREIGN PATENT DOCUMENTS 0 068 340 1/1983 European Pat. Off. .

*Primary Examiner*—Kenneth J. Dorner
*Assistant Examiner*—William L. Miller
*Attorney, Agent, or Firm*—Blakely Sokoloff, Taylor & Zafman

[57] ABSTRACT

In a phase adjustment fixing apparatus for a cam, a cam fixing shaft is supported by a frame to freely move and has a clamp for clamping a cam at one end portion. A pressure unit is slidably supported on the cam fixing shaft and has a slidably supported lever. A spring member is interposed between the other end portion of the cam fixing shaft and the pressure unit. A sliding element is arranged at a swinging end of the lever to slide on a surface of the frame. An actuator swings the lever to move the sliding element between a cam fixing position where the sliding element slightly goes across a dead center and a cam fixed state releasing position where the sliding element largely comes across the dead center. A dead center is a position where the sliding element crosses a center line of the cam fixing shaft. At the cam fixing position of the sliding element, the pressure unit slides toward the other end portion of the cam fixing shaft to bias the cam fixing shaft in a direction to fix the cam through the spring member, and at the cam fixed state releasing position of the sliding element, the pressure unit releases a biasing force from the cam fixing shaft through the spring member.

10 Claims, 6 Drawing Sheets

PHASE ADJUSTMENT FIXING APPARATUS FOR CAM

BACKGROUND OF THE INVENTION

The present invention relates to a phase adjustment fixing apparatus for an annular cam, suitably used in the folder of a printing press or the like, to pivot the cam in a circumferential direction for phase adjustment and fix the cam at an adjustment position.

"The folder of a web-fed rotary printing press has a folding cylinder group comprising a cutting cylinder, a folder cylinder and a gripping cylinder, which have a cutting knife, a needle and a folding knife, and a gripping plate, as folding members, on respective outer surfaces, to cut web paper after a printing operation into a predetermined size and fold the paper." A cam for operating the above-mentioned folding members is positioned at the shaft end portion of the folding cylinder group and supported on the frame side.

FIG. 8 shows the shaft end portion of the folding cylinder of a conventional folding cylinder group of this type. This arrangement will be described with reference to FIG. 8. A folding cylinder 101 has its end shaft 104 rotatably axially supported by a bearing 103 fixed to a machine frame 102. A cylindrical cam holder 105 is pivotally fitted on the outer surface of the bearing 103. The cam holder 105 is adjusted in a predetermined phase by a phase adjustment fixing apparatus (to be described later) and fixed. An annular cam 106 having a cam surface on its outer surface is fixed on the end face of the cam holder through a plurality of bolts 107.

A plurality of clamps 110 constituting the phase adjustment fixing apparatus for the cam 106 are supported by screw shafts 112 slidably inserted to the shaft holes of the frame 102 to freely move in a direction parallel to the axis of the folding cylinder 101. Pivotal motion of the clamp 110 about the axis of the screw shaft 112 is regulated by a pin 111 extending upright from the frame 102. Each clamp 110 has a step portion 110*a* engaged with a corresponding step portion 105*a* of the cam holder 105, and a step portion 110*b* engaged with the head portion of the corresponding screw shaft 112 to regulate the pivotal motion. Reference numeral 113 denotes one of fixing handles threadably engaged with the screw portions of the plurality of screw shafts 112.

The shaft portion of a phase adjustment handle 114 is rotatably inserted to another shaft hole of the frame 102. A gear 115 fixed to the projecting portion of the shaft portion of the phase adjustment handle 114 meshes with a gear 105*b* arranged on part of the outer surface of the cam holder 105.

With this arrangement, when the fixing handles 113 are held and rotated, the screw shafts 112 are pulled by the screw function of the female screw portions of the fixing handles 113, and the clamps 110 are clamped, so that the cam 106 is fixed through the cam holder 105 engaged with the clamps 110. When the printing operation is started, and the folding cylinder 101 is rotated, a cam follower 108 pressed against the cam surface of the cam 106 moves in a radial direction of the folding cylinder 101 to swing a cam lever 109. With a predetermined operation of needles and a knife coupled to the cam lever 109, a folding operation is performed.

In such a folder, when the folding specifications for printed matter change, the phase of the cam 106 in the circumferential direction must be adjusted. For this purpose, the plurality of fixing handles 113 are rotated to release the fixed state of the cam holder 105 by the clamps 110, and the phase adjustment handle 114 is rotated. With this operation, the gear 115 meshes with the gear 105*b* on the cam holder 105 side, so that the phase of the cam 106 is adjusted. Thereafter, the plurality of fixing handles 113 are rotated to fix the cam 106 through the cam holder 105 again.

In such a conventional phase adjustment fixing apparatus for a cam, however, every time the specifications for printed matter change, the plurality of fixing handles 113 must be rotated to release the fixed state of the cam holder 105, thereby adjusting the phase of the cam 106. Thereafter, the plurality of fixing handles 113 must be rotated again to fix the cam 106. This adjustment process takes a long time to result in a decrease in productivity. In addition, the work load on the operator increases. Particularly for the folder, not only the folding cylinder but also the remaining cylinders must be phase-adjusted depending on the folding specifications, and this operation takes a longer time and further increases the work load.

SUMMARY OF THE INVENTION

It is an object of the present invention to provide a phase adjustment fixing apparatus for a cam, which can shorten the time and decrease the work load in phase adjustment of a cam.

In order to achieve the above object, according to the present invention, there is provided a phase adjustment fixing apparatus for a cam, comprising a cam fixing shaft supported by a frame to freely move and having a clamp for clamping a cam at one end portion, a pressure unit slidably supported on the cam fixing shaft and having a slidably supported lever, a spring member interposed between the other end portion of the cam fixing shaft and the pressure unit, a sliding element arranged at a swinging end of the lever to slide on a surface of the frame, and an actuator for swinging the lever to move the sliding element between a cam fixing position where the sliding element slightly goes across a dead center and a cam fixed state releasing position where the sliding element largely comes across the dead center, the dead center being a position where the sliding element crosses a center line of the cam fixing shaft, wherein, at the cam fixing position of the sliding element, the pressure unit slides toward the other end portion of the cam fixing shaft to bias the cam fixing shaft in a direction to fix the cam through the spring member, and at the cam fixed state releasing position of the sliding element, the pressure unit releases a biasing force from the cam fixing shaft through the spring member.

DESCRIPTION OF THE PREFERRED EMBODIMENTS

Figure 3:
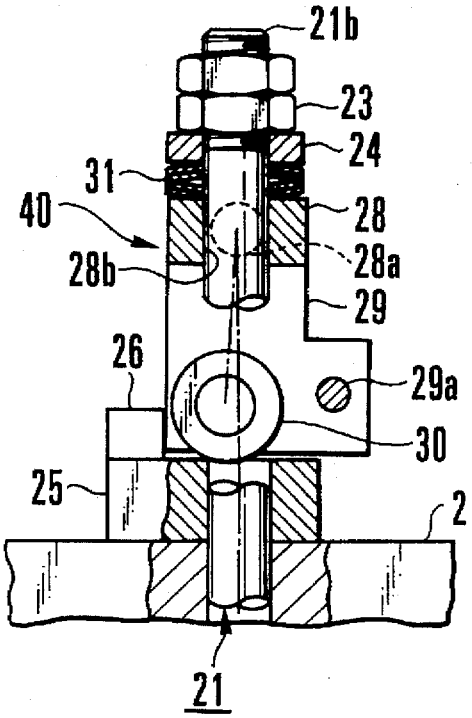
FIG. 3 is a partially cutaway plan view showing a state wherein the biasing force of a spring member acts while the rollers of the phase adjustment fixing apparatus shown in FIG. 1 slightly come across the dead center.
Figure 4:
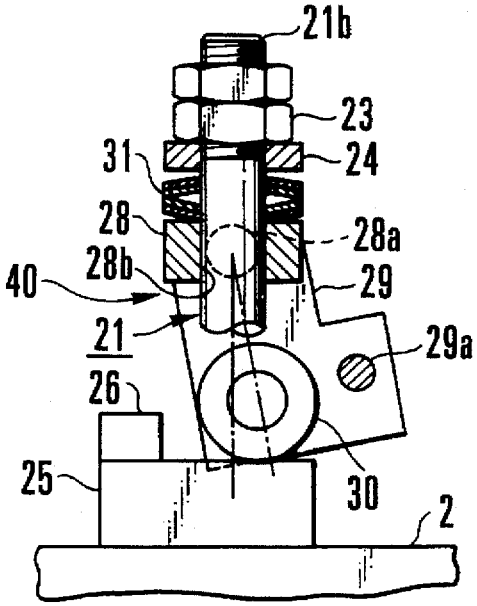
FIG. 4 is a partially cutaway plan view showing a state wherein the biasing force of the spring member is released while the rollers of the phase adjustment fixing apparatus shown in FIG. 1 largely come across the dead center to the other side.
Figure 5:
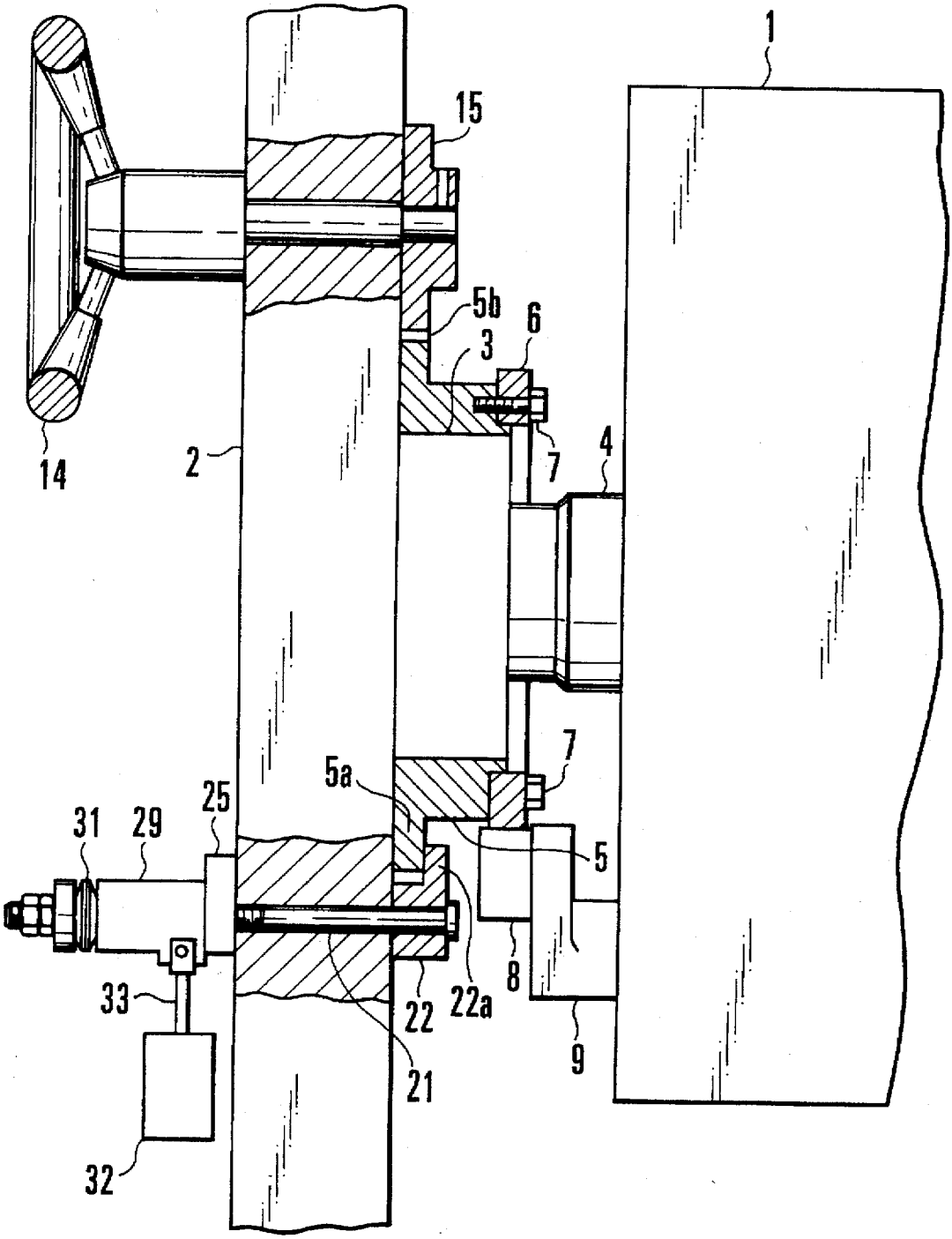
FIG. 5 is a partially cutaway front view of the shaft end portion of a folding cylinder including the phase adjustment fixing apparatus shown in FIG. 1.

FIGS. 1 to 4 show a phase adjustment fixing apparatus for a cam according to the first embodiment of the present invention. FIG. 5 shows the shaft end portion of a folding cylinder including the phase adjustment fixing apparatus.

Referring to FIG. 5, a folding cylinder 1 has its end shaft 4 rotatably axially supported by a bearing 3 fixed to a machine frame 2. A cylindrical cam holder 5 is pivotally fixed on the outer surface of the bearing 3, adjusted in a predetermined phase, and fixed. An annular cam 6 having a cam surface on its outer surface is fixed on the end face of the cam holder 5 through a plurality of bolts 7. A plurality of clamps 22 constituting the phase adjustment fixing apparatus are supported by cam fixing shafts 21 slidably inserted to the shaft holes of the frame 2 to freely move in a direction parallel to the axis of the folding cylinder 1. Each clamp 22 has a step portion 22*a* engaged with a corresponding step portion 5*a* of the cam holder 5. On the other hand, the shaft portion of a phase adjustment handle 14 is rotatably inserted to another shaft hole of the frame 2. A gear 15 fixed to the projecting portion of the shaft portion of the phase adjustment handle 14 meshes with a gear 5*b* arranged on part of the outer surface of the cam holder 5.

Figure 1:
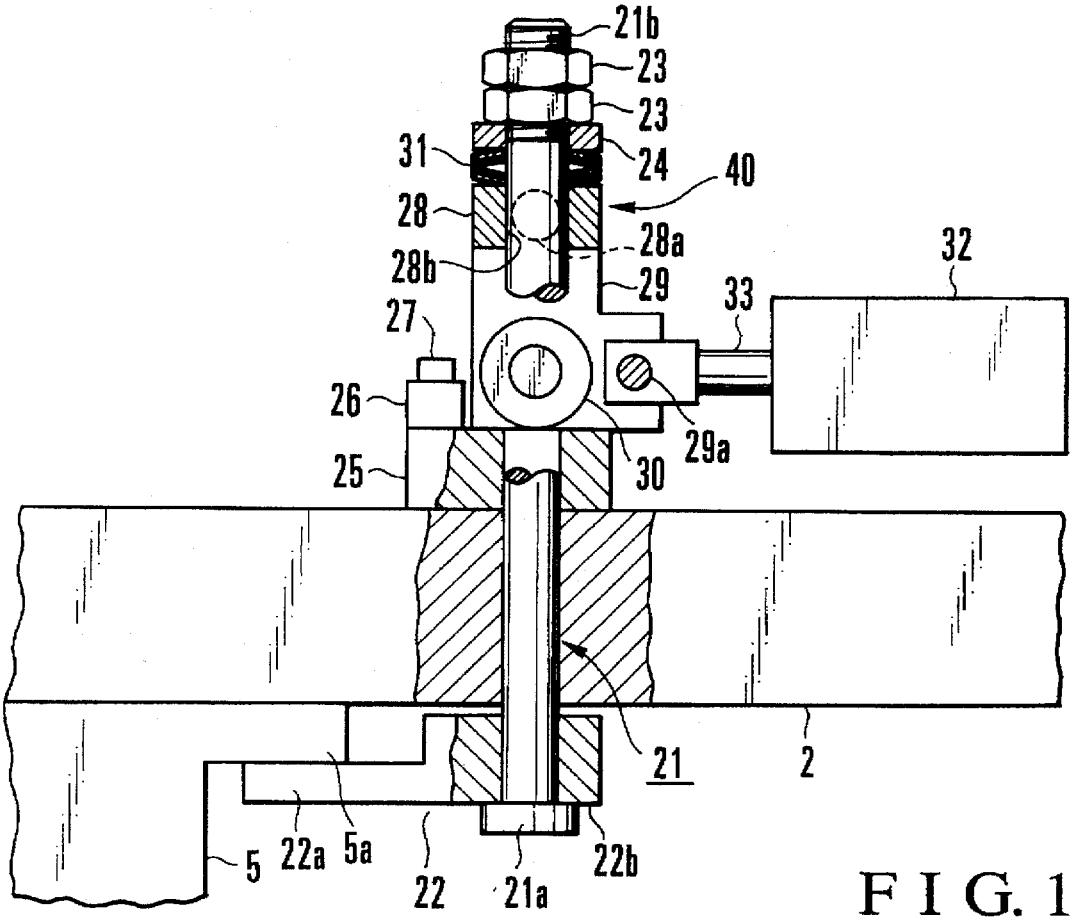
FIG. 1 is a partially cutaway plan view showing a phase adjustment fixing apparatus for a cam according to the first embodiment of the present invention.

In FIG. 1, each clamp 22 having its step portion 22*a* engaged with the corresponding outer step portion 5*a* of the cam holder 5 is held by the projecting portion of the cam fixing shaft 21 on the cam holder 5 side, so that the pivotal motion of the clamp 22 is regulated. A head portion 21*a* of the cam fixing shaft 21 engages with an end face 22*b* of the clamp 22. A screw portion 21*b* is formed at the projecting portion of the cam fixing shaft 21 on the other end side. A double nut 23 serving as a stopper is threadably engaged with the screw portion 21*b* to be freely adjusted in its movement. Reference numeral 24 denotes a washer adjacent to the double nut 23 on the frame 2 side and fitted on the cam fixing shaft 21.

Figure 2:
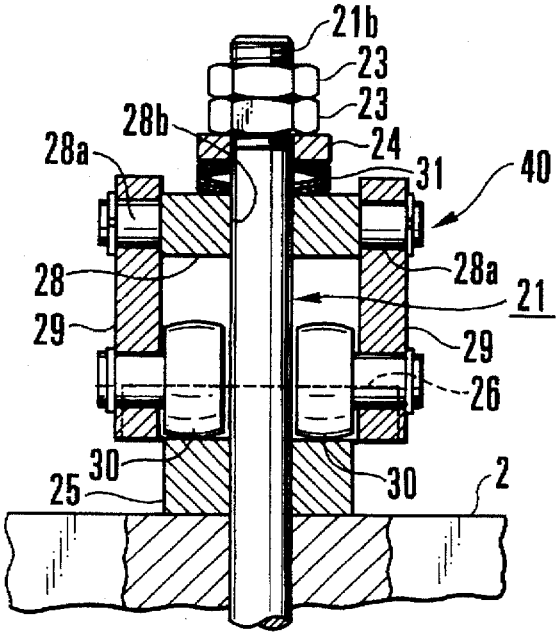
FIG. 2 is a partially cutaway side view of the phase adjustment fixing apparatus shown in FIG. 1.

A block 25 for slidably supporting the intermediate portion of the cam fixing shaft 21 is fixed on the outer side of the frame 2 through a bolt 27 together with a stopper member 26 (to be described later) while its attachment surface contacts the surface of the frame 2. As shown in FIG. 2, a pressure element 28 having pins 28*a* on both the sides is arranged on the frame 2 side of the washer 24 to freely slide along the cam fixing shaft 21. A pair of levers 29 having an L shape are pivotally held by the pins 28*a* on both the sides of the pressure element 28. The pressure element 28 and the levers 29 constitute a pressure unit 40. The pressure element 28 having a through hole 28*b* through which the cam fixing shaft 21 extends also functions as a guide member for the pressure unit 40.

Rollers 30 having their outer surfaces in contact with the surface of the block 25 are rotatably pivotally mounted at the swinging end portions of the pair of levers 29. A plurality of coned disc springs 31 serving as spring members for biasing the cam fixing shaft 21 are interposed between the pressure element 28 and the washer 24 such that the rollers 30 are pressed against the surface of the block 25.

Reference numeral 32 denotes an air cylinder serving as an actuator with its cylinder portion pivotally supported by the frame 2. The operating end of a rod 33 of the air cylinder 32 is pivotally mounted at the swinging end portions of the levers 29 through a shaft 29*a* extending between the pair of levers 29. When the rod 33 is moved by an air pressure to swing the levers 29, the rollers 30 roll on the block 25 and are displaced between a dead center position where the center of each roller 30 is set on the center line of the cam fixing shaft 21, as shown in FIG. 1, a cam fixing position where the center slightly comes across the dead center to one side, as shown in FIG. 3, and a cam fixed state releasing position where the center goes across the dead center to the other side, as shown in FIG. 4.

In FIG. 1, the biasing force of the coned disc springs 31 is maximized. At the cam fixing position shown in FIG. 3, the biasing force of the coned disc springs 31 stably sufficiently acts. At the cam fixed state releasing position shown in FIG. 4, the biasing force of the coned disc springs 31 is released.

The operation of the phase adjustment fixing apparatus for a cam having the above arrangement will be described. The rod 33 of the air cylinder 32 is moved forward from the cam fixed state releasing position where a small gap is formed between the coned disc springs 31 and the washer 24, as shown in FIG. 4. The levers 29 of the pressure unit 40, which are coupled to the operating end of the rod 33, swing clockwise in FIG. 4 as the rollers 30 roll on the block 25. With this operation, the pressure unit 40 slides to the opposite side of the cam holder 5 along the cam fixing shaft 21, so that the pressure element 28 presses the coned disc springs 31. Since the coned disc springs 31 are brought into contact with the washer 24 and thereafter compressed, the cam fixing shaft 21 is moved to the opposite side of the cam holder 5, i.e., in a direction to fix the cam, by the elastic force of the coned disc springs 31 through the washer 24 and the double nut 23.

When the cam fixing shaft 21 moves, the clamp 22 coupled to the end portion of the cam fixing shaft 21 also moves, so that the cam holder 5 is fixed by the clamps 22. The holding force at this time is maximized at the dead center position where the rollers 30 come to the center line of the cam fixing shaft 21, as shown in FIG. 1. The levers 29 continue to slightly swing. The swinging motion of the levers 29 stops at the cam fixing position where the levers 29 abut against the stopper member 26, as shown in FIG. 3. At this cam fixing position, the levers 29 are set across the dead center while the elastic force of the coned disc springs 31 sufficiently acts. For this reason, the cam holder 5 can be stably held while preventing the levers 29 from pivoting to the other side, i.e., in a direction to release the cam fixed state.

At this time, the levers 29 are also stably held at the cam fixing position, and pressure transmission from the air cylinder 32 can be stopped. Therefore, the air cylinder 32 performs only the clamping/releasing operation of the clamps 22. Since the holding force of the clamps 22 for the cam holder 5 is obtained in accordance with the elastic force of the coned disc springs 31, a large holding force can be obtained. This holding force is not released even in a case of power failure.

When the folding specifications for printed matter change after the printing operation, the rod 33 of the air cylinder 32 is moved backward. The levers 29 swing counterclockwise in FIG. 3 and stop at the cam fixed state releasing position where the rollers 30 come across the dead center to the other side, as shown in FIG. 4. At this time, the pressure element 28 slides to the cam holder 5 side, so that a small gap is formed between the coned disc springs 31 and the washer 24. The cam fixing shaft 21 moves in a direction to release the cam fixed state, so that the fixed state of the cam holder 5 by the clamps 22 is released.

Subsequently, as in the prior art, a phase adjustment handle 13 is rotated. With this operation, the gear 15 meshes with the gear 5*a* on the cam holder side, and the phase of the cam 6 is adjusted. Thereafter, the rod 33 of the air cylinder 32 is moved forward, as in the previous operation, to swing the levers 29, so that the cam holder 5 is fixed by the clamps 22 again.

Figure 6A:
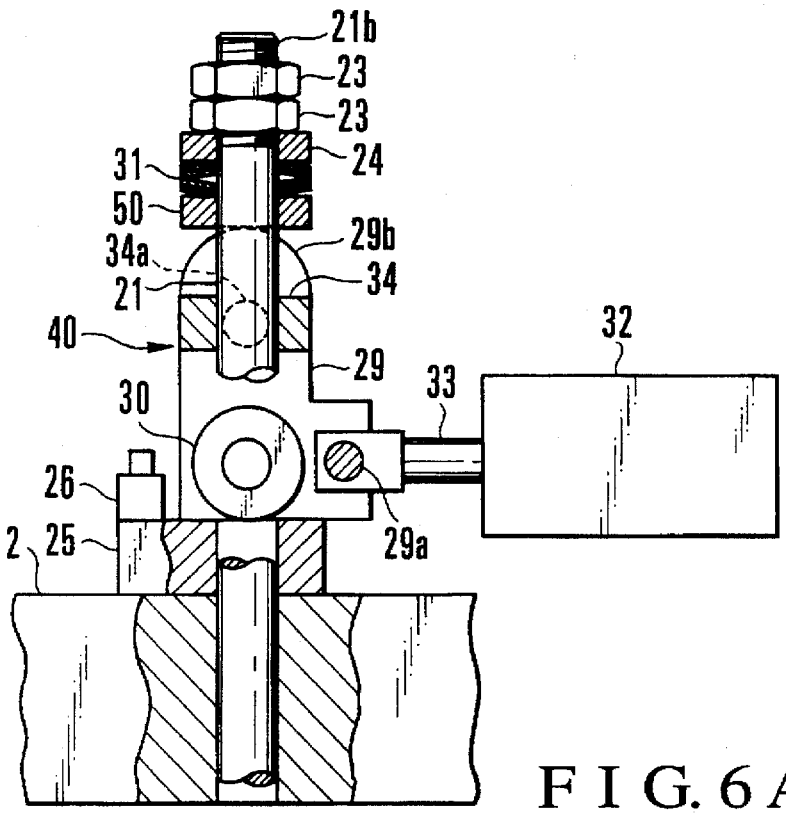
FIGS. 6A and 6B are partially cutaway plan and front views, respectively, showing a phase adjustment fixing apparatus according to the second embodiment of the present invention.
Figure 6B:
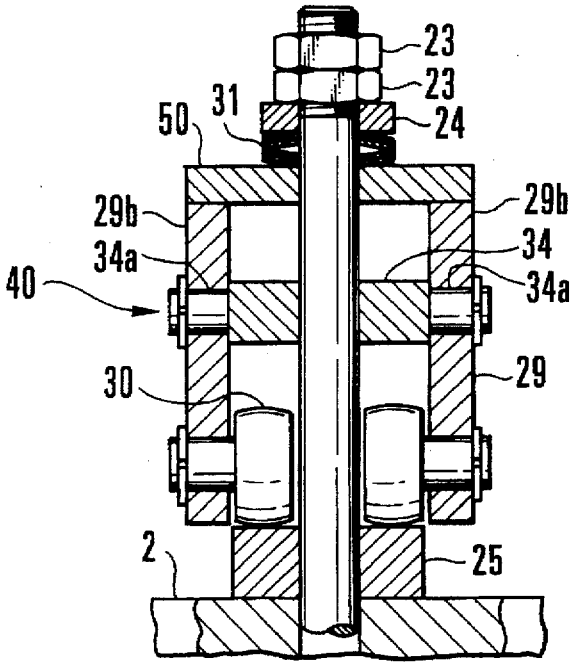

FIGS. 6A and 6B show a phase adjustment fixing apparatus according to the second embodiment of the present invention. In this embodiment, a washer 50 serving as a sliding member is arranged between a pressure unit 40 and coned disc springs 31. In addition, end faces 29*b* of levers 29 on the washer 50 side are formed into an arcuate shape and pressed through the washer 50. In this embodiment, a member 34 does not have a function as a pressure member for the coned disc springs 31, unlike the first embodiment, but the member 34 serves as a holding member for swingably holding the levers 29 through pins 34. As in the first embodiment, the holding member 34 guides the pressure unit 40 along a cam fixing shaft 21. Since the remaining arrangements and operations are the same as in the first embodiment, the same reference numerals as in the first embodiment denote the same parts, and a detailed description thereof will be omitted.

Figure 7:
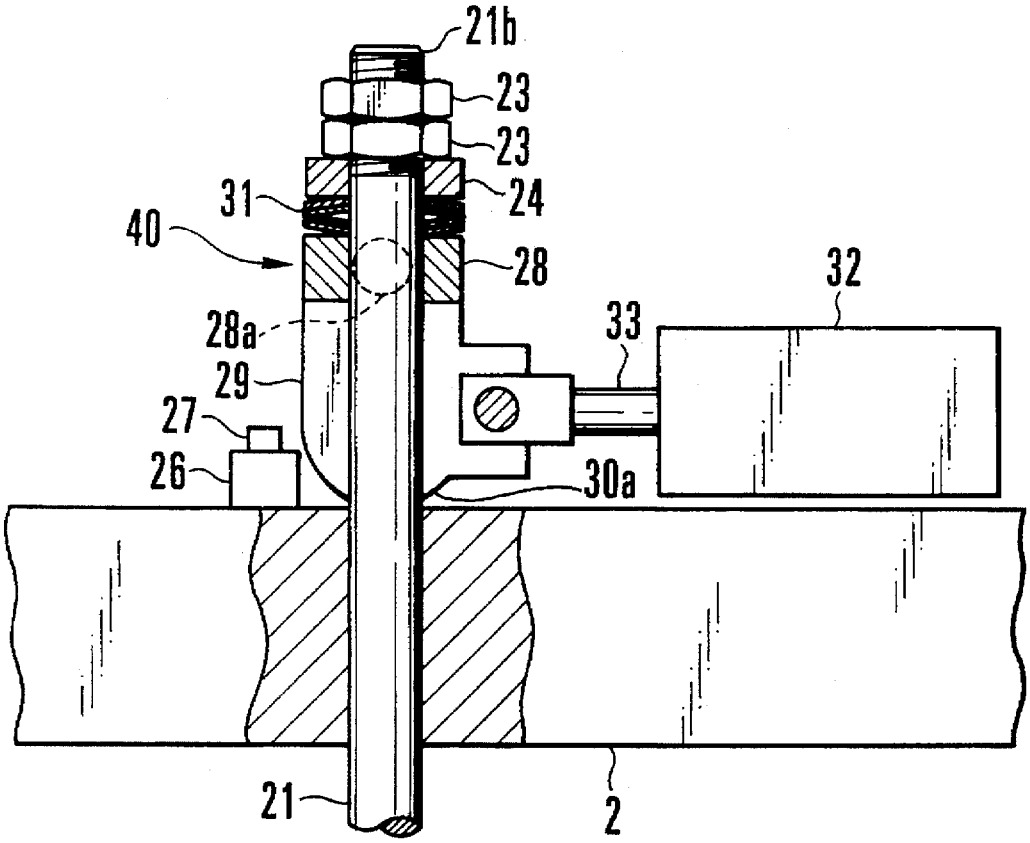
FIG. 7 is a partially cutaway plan view showing a phase adjustment fixing apparatus according to the third embodiment of the present invention.
Figure 8:
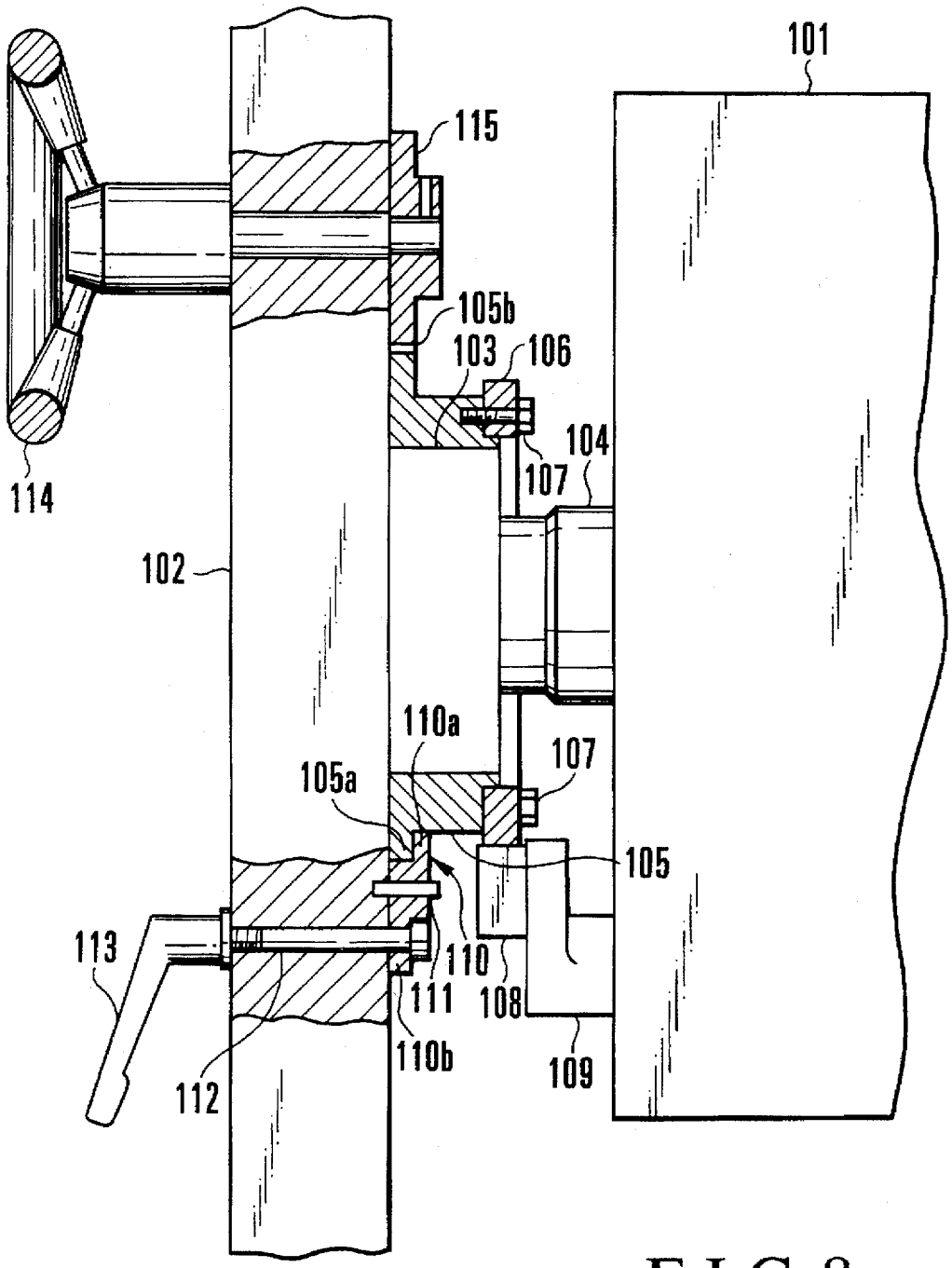
F I G. 8 PRIOR ART
FIG. 8 is a partially cutaway front view showing the shaft end portion of a conventional folding cylinder.

FIG. 7 shows a phase adjustment fixing apparatus according to the third embodiment of the present invention. The block 25 and the rollers 30 contacting the surface of the block 25 in the first embodiment are omitted. More specifically, in the first embodiment, the rollers 30 are used as sliding elements. However, in the third embodiment, the end faces of levers 29 on a frame 2 side are formed as arcuate surfaces 30*a* which can smoothly slide and brought into a direct slidable contact with the surface of the frame 2. Therefore, in this embodiment, the levers 29 swing in accordance with not the rolling motion of the rollers 30, unlike the first embodiment, but the sliding motion of the arcuated surfaces 30*a* of the levers 29 on the surface of the frame 2. Since the remaining arrangements and operations are the same as in the first embodiment, the same reference numerals as in the first embodiment denote the same parts, and a detailed description thereof will be omitted.

In each of the above embodiments, the cam 6 is held through the cam holder 5. However, the present invention can also be applied to an apparatus for directly holding the cam 6 by clamps. In each of the above embodiments, the present invention is implemented for the cam 6 of a folder. However, the present invention is not limited to this and can also be implemented for a cam of another apparatus.

In each of the above embodiments, the manually operated phase adjustment handle 14 is used. In place of this handle 14, driving units such as a motor, a rotary actuator, and an air cylinder can be coupled to each other to adjust the phase of the cam in correspondence with folding specifications for printed matter. With this arrangement, the phase adjustment operation for the cam 6 can be automated. Therefore, the preparation time can be shortened, and the work load can be decreased. In addition, the productivity and safety can be increased.

As is apparent from the above description, according to the phase adjustment fixing apparatus for a cam of the present invention, the cam can be fixed, or the fixed state can be released only by swinging the levers through the actuator in phase adjustment for the cam. With this arrangement, the adjustment time can be largely shortened as compared to the prior art in which a plurality of handles are manually rotated a number of times. Therefore, the productivity can be increased, and the work load can be largely decreased. When the cam is fixed, the sliding element comes across the dead center. For this reason, the clamps can be prevented from moving in a direction to release the fixed state, so that the safety and productivity can be increased.

What is claimed is:

1. A phase adjustment fixing apparatus for a cam, comprising:

a cam fixing shaft supported by a frame to freely move and having a clamp for clamping the cam at one end portion;

a pressure unit slidably supported on said cam fixing shaft and having a slidably supported lever;

a spring member interposed between the other end portion of said cam fixing shaft and said pressure unit;

a sliding element arranged at a swinging end of said lever to slide on a surface of said frame; and an actuator for swinging said lever to move said sliding element between a cam fixing position where said sliding element slightly goes across a dead center and a cam fixed state releasing position where said sliding element largely comes across the dead center, the dead center being a position where said sliding element crosses a center line of said cam fixing shaft, wherein, at the cam fixing position of said sliding element, said pressure unit slides toward the other end portion of said cam fixing shaft to bias said cam fixing shaft in a direction to fix said cam through said spring member, and at the cam fixed state releasing position of said sliding element, said pressure unit releases a biasing force from said cam fixing shaft through said spring member.

2. An apparatus according to claim 1, further comprising a stopper member fixed at the other end portion of said cam fixing shaft, and a pressure element arranged in said pressure unit to oppose said stopper member, and wherein, at the cam fixing position of said sliding element, said pressure element biases said cam fixing shaft in a direction to fix said cam through said spring member and said stopper member.

3. An apparatus according to claim 2, wherein said pressure element has a through hole for guiding said pressure unit in an axial direction of said cam fixing shaft, through which said cam fixing shaft extends.

4. An apparatus according to claim 1, further comprising a stopper member fixed at the other end portion of said cam fixing shaft, and a sliding member slidably supported on said cam fixing shaft and interposed between said spring member and said pressure unit, and wherein said lever has an arcuated end face opposing said sliding member, and when said arcuated end face of said lever presses said sliding member, said cam fixing shaft is biased through said spring member and said stopper member in a direction to fix said cam.

5. An apparatus according to claim 4, wherein said sliding member is constituted by a washer.

6. An apparatus according to claim 1, wherein said sliding element is constituted by an arcuated swinging end face of said lever, which is formed to oppose said frame, and said swinging end face of said lever directly slides on said surface of said frame.

7. An apparatus according to claim 1, wherein said sliding element is constituted by a roller pivotally supported by said lever to roll on said surface of said frame.

8. An apparatus according to claim 1, wherein said actuator moves said sliding element, across the dead center, between the cam fixing position on one side of the dead center and the cam fixed state releasing position on the other side of the dead center.

9. An apparatus according to claim 1, further comprising a stopper member for stopping said sliding element at the cam fixing position.

10. An apparatus according to claim 1, further comprising a block member fixed on said surface of said frame, on which said sliding member slides.

* * * * *